US011247239B2

(12) United States Patent
Vujadinovic

(10) Patent No.: US 11,247,239 B2
(45) Date of Patent: Feb. 15, 2022

(54) APPARATUS FOR SEPARATING PARTICLES OF DIFFERENT SIZES BY MEANS OF CYCLONIC SEPARATION

(71) Applicant: Klingmill AB, Eskilstuna (SE)

(72) Inventor: Borislav Vujadinovic, Eskilstuna (SE)

(73) Assignee: Klingmill AB, Eskilstuna (SE)

( * ) Notice: Subject to any disclaimer, the term of this patent is extended or adjusted under 35 U.S.C. 154(b) by 0 days.

(21) Appl. No.: 16/769,423

(22) PCT Filed: Nov. 30, 2018

(86) PCT No.: PCT/EP2018/083220
§ 371 (c)(1),
(2) Date: Jun. 3, 2020

(87) PCT Pub. No.: WO2019/110451
PCT Pub. Date: Jun. 13, 2019

(65) Prior Publication Data

US 2020/0368784 A1 Nov. 26, 2020

(30) Foreign Application Priority Data

Dec. 4, 2017 (EP) ..... 17205229

(51) Int. Cl.
*B07B 7/01* (2006.01)
*B07B 7/086* (2006.01)

(52) U.S. Cl.
CPC ..... *B07B 7/086* (2013.01); *B07B 7/01* (2013.01)

(58) Field of Classification Search
CPC ..... B07B 7/01; B07B 7/086; B07B 4/02
See application file for complete search history.

(56) References Cited

U.S. PATENT DOCUMENTS 1,557,333 A * 10/1925 Robinson ..... B04C 5/02 209/139.1
4,010,097 A * 3/1977 Murray ..... B07B 4/02 209/139.1

(Continued)

FOREIGN PATENT DOCUMENTS

CH 314655 A 6/1956
DE 433256 C 8/1926

(Continued)

*Primary Examiner* — Patrick H Mackey
(74) *Attorney, Agent, or Firm* — Dilworth & Barrese, LLP

(57) ABSTRACT

The present invention relates to an apparatus for separating smaller particles from larger particles by means of cyclonic separation. The apparatus comprises a feeding pipe (2) having an upper end (2*a*) for receiving material to be separated and defining a first channel (3) for transporting the material to a lower end (2*b*) of the feeding pipe, a separation chamber (5) having a curved wall (7), a first opening (6*a*) arranged at an upper end (5*a*) of the separation chamber, a second opening (6*b*) arranged at a lower end (5*b*) of the separation chamber, and the separation chamber (5) surrounds the feeding pipe (2) such that a second channel (8) is formed between the feeding pipe and the curved wall (7), an air inlet unit (12) arranged for supplying air to the second opening (6*b*) of the separation chamber, and an outlet unit (15) arranged for receiving air and separated material from the first opening (6*a*) of the separation chamber and to discharge the air and separated material. The curved wall (7) is conically shaped and tapers from the second opening (6*b*) to the first opening (6*a*), and the feeding pipe and the separation chamber are concentrically arranged.

16 Claims, 3 Drawing Sheets

(56) References Cited

U.S. PATENT DOCUMENTS

| | | | | | |
|---|---|---|---|---|---|
| 4,526,678 | A * | 7/1985 | Myhren | B04C 9/00 | 209/139.2 |
| 4,715,951 | A * | 12/1987 | Krambrock | B07B 7/02 | 209/138 |
| 4,834,586 | A | 5/1989 | Depew | | |
| 4,996,538 | A | 2/1991 | Brecy et al. | | |
| 5,294,002 | A * | 3/1994 | Moses | B07B 4/02 | 209/135 |
| 7,108,138 | B2 | 9/2006 | Simpson | | |
| 7,621,975 | B2 * | 11/2009 | Schneider | B07B 4/02 | 55/315 |

FOREIGN PATENT DOCUMENTS

| | | | |
|---|---|---|---|
| EP | 0 135 999 | A1 | 4/1985 |
| EP | 2 291 233 | B2 | 9/2019 |
| JP | H7-289998 | A | 11/1995 |
| JP | 2002-66459 | A | 3/2002 |
| WO | 2014/016207 | A1 | 1/2014 |
| WO | 2016/186439 | A1 | 11/2016 |

* cited by examiner

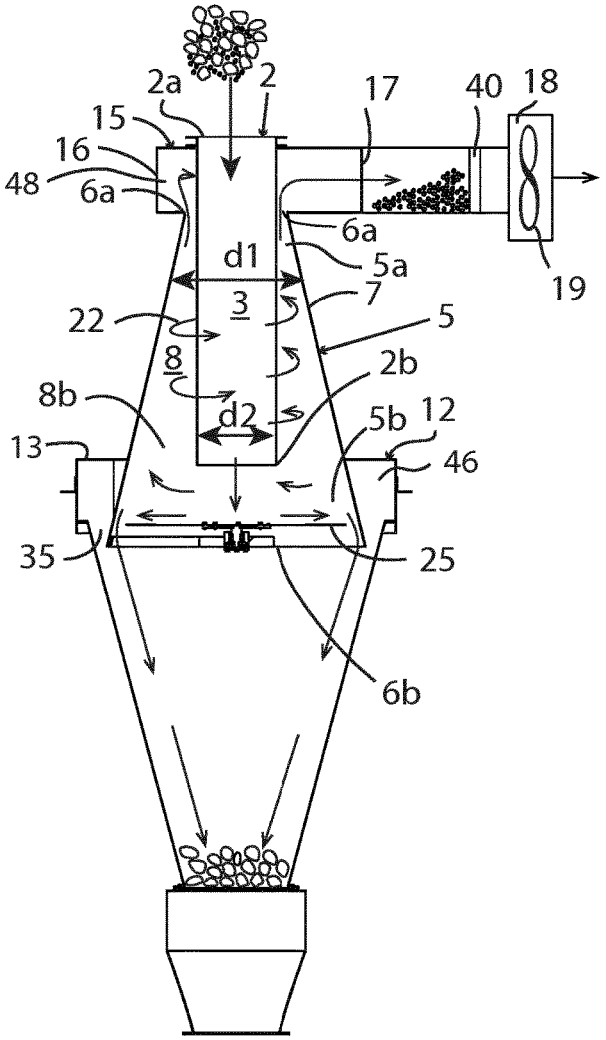
B - B Fig.4
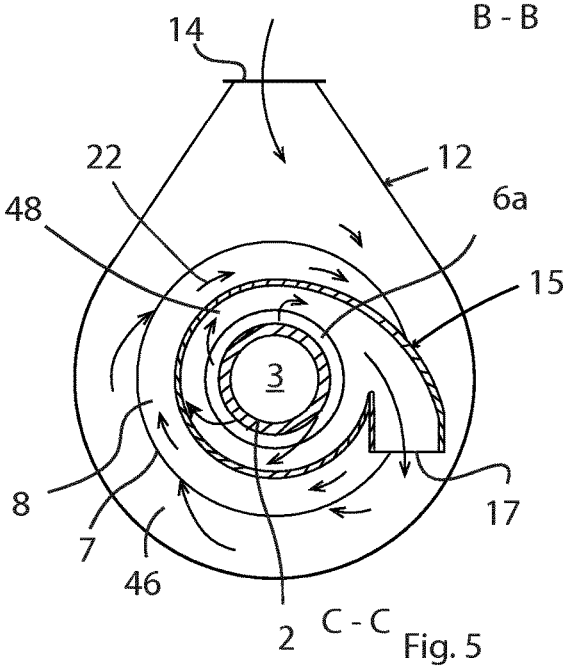
C - C Fig. 5
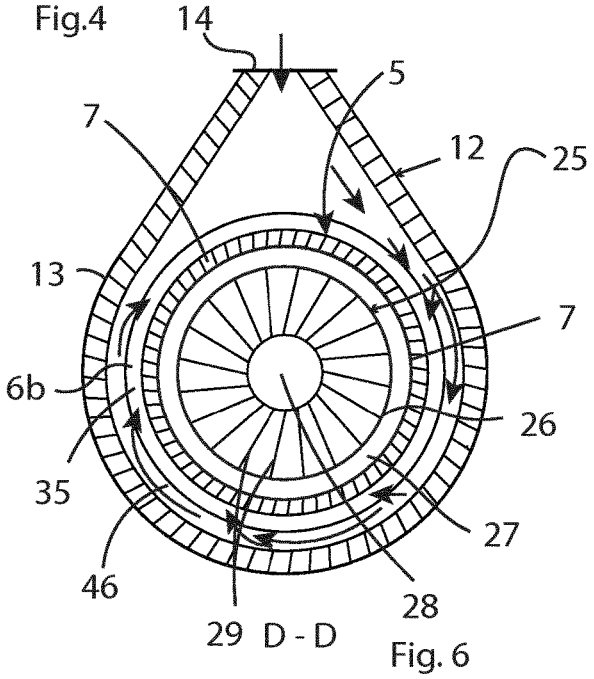
D - D Fig. 6

APPARATUS FOR SEPARATING PARTICLES OF DIFFERENT SIZES BY MEANS OF CYCLONIC SEPARATION

TECHNICAL FIELD

The present invention relates to an apparatus for separating smaller particles from larger particles by means of cyclonic separation. The invention also relates to use of such an apparatus for separating wood particles from a wood powder.

BACKGROUND

In many applications it is necessary to separate particles of different sizes or density. An air classifier is an apparatus that separates materials with different sizes and density. It works by injecting a stream of material to be sorted into a separation chamber which contains a vertical column of rising air. Inside the separation chamber, the air drag on the material supplies an upward force which counteracts the force of gravity and lifts the material to be sorted up into the air. Due to the dependence of air drag on size and shape of an object, the particles in the moving air column are sorted vertically and can be separated in this manner. Air classifiers are commonly employed in industrial processes where a large volume of mixed materials with differing physical characteristics need to be separated quickly and efficiently.

Cyclonic separation is a method of removing particles from air, gas or liquid streams, without the use of filters, through vortex separation. Rotational effects and gravity are used to separate mixtures of solids and air. A high-speed rotating air flow is established within a cylindrical or conical container called a cyclone. The air flows in a helical pattern. Larger particles in the rotating stream have too much inertia to follow the tight curve of the stream, and strike the outside wall, then fall to the bottom of the cyclone where they can be removed. The rotating air flow moves towards a narrow end of the cyclone thus separating smaller and smaller particles. The cyclone geometry, together with volumetric flow rate, defines the cut-off point for the particle size of the cyclone. This defines the size of particles that will be removed from the stream with at least 50% efficiency. Particles larger than the cut-off point will be removed with a greater efficiency, and smaller particles with a lower efficiency.

There is as desire to use wood powder as a replacement of fossil fuel. The size of the particles of the wood powder is essential for the use of the wood powder as fuel. Thus, there is a desire to provide an apparatus that makes it possible to separate larger wood particles from smaller to achieve wood powder including particles of desired sizes. A problem with separating wood particles from wood powder is that wood material becomes lumped when it is moist, which makes it difficult to separate the particles. Thus, an efficient separation is needed.

U.S. Pat. No. 7,108,138 discloses a material classifier that includes a cyclone comprising a cyclone inlet, a cyclone outlet, a blower and a blower discharge; an air diffuser connected at a diffuser inlet to the cyclone outlet and at a diffuser outlet to an air lock such that the cyclone and air diffuser are in fluid communication; wherein the diffuser including a central cylindrical portion including an air inlet for admitting controlled amounts of diffuser air around substantially the entire cylinder outer periphery of the central cylindrical portion, wherein the material classifier separating fine particles from coarse particles and discharging the fine particles together with air out the blower discharge, and discharging the coarse particles through the air lock, such that varying the amount of diffuser air one can control the size of the fine particles being separated from the coarse particles.

U.S. Pat. No. 4,526,678 discloses an apparatus for separating large from small particles suspended in a moving stream of gas by centrifugal forces which includes sifting of large particles in a stream of gas to strip small particles away from the larger particles.

DE433256 discloses an apparatus for separating large particles from small particles, wherein the apparatus comprises a separation chamber, an air inlet, an outlet and a feeding pipe. The material is disposed in the separation chamber by means of the feeding pipe. By means of an air flow created by the air inlet unit the lighter material is elevated in the separation chamber and is then fed through the outlet unit. The heavier material falls down to a separate outlet. The apparatus does not use cyclonic separation.

CH314655 discloses an apparatus for separating large particles from small particles, wherein the apparatus comprises a separation chamber, an outlet, and air inlet, a feeding pipe. The material is supplied to the separation chamber through the feeding pipe and then falls on a displacement body causing the material to be evenly distributed. The air coming from the air inlet then causes the lighter material to be elevated to the outlet. This apparatus does not use cyclonic separation.

A problem with the prior art apparatus is that they do not provide efficient separation of material including lumps, such as moist wood material. For example, the shape of the separation chamber does not now allow for a constant air flow, resulting in less efficient separation. Further, the arrangement and design of the feeding pipe may cause the material to become stuck in the feeding pipe.

SUMMARY

An aspect of the present invention is to provide an improved apparatus for separating smaller particles from larger particles in a material containing particles of different sizes. More specifically, the disclosure provides for an apparatus that enables efficient separation of moist material containing lumps. Yet another aspect of the disclosure is to provide an apparatus achieving efficient separation of wood particles.

This aspect is achieved by an apparatus as defined herein.

The apparatus comprises a feeding pipe having an upper end for receiving material to be separated and defining a first channel for transporting the material to a lower end of the feeding pipe, a separation chamber having a curved wall, a first opening arranged at an upper end of the separation chamber, a second opening arranged at a lower end of the separation chamber, and the separation chamber surrounds the feeding pipe such that a second channel is formed between the feeding pipe and the curved wall. The feeding pipe and the separation chamber are concentrically arranged. The apparatus comprises an air inlet unit arranged for supplying air to the second opening of the second channel, and an outlet unit arranged for receiving air and separated material from the first opening of the second channel and to discharge the air and separated material. The curved wall is conically shaped and tapers from the second opening to the first opening of the separation chamber, and the feeding pipe and the separation chamber are concentrically arranged.

The rotating air flow is flowing upwards from the lower end of the second channel to the upper end of the second channel. The material is separated by means of the rotating air flow since larger particles are moved downwards due to gravity and smaller particles follow the rotating air flow. Larger particles that follow the rotating air flow will strike the wall of the separation chamber, and then fall downwards due to gravity. Thus, the smallest particles remain in the air flow the longest and travel the highest in the second channel.

Due to the fact that the curved wall of the separation chamber is conically shaped and tapers from the second opening to the first opening of the separation chamber, the curved wall continually decreases from the air inlet to the air outlet of the separation chamber. The steepness of the curved wall prevents heavier particles from moving to the upper end of the separation chamber and allows lighter particles to move to the upper end of the second channel. The conical shape of the curved wall allows for a constant air flow without disturbances. The separation is further improved by having the feeding pipe and the separation chamber concentrically arranged. This along with the conical shape of the curved wall creates a uniform airflow towards the upper end, preventing the air flow to vary, resulting in an efficient separation of the particles.

Since the curved wall is conically shaped, the radius of separation chamber continuously decreases from the second opening of the separation chamber, where the air is inlet, to the first opening of the separation chamber, where the air is outlet. Thus, also the second channel is conically shaped and continuously decreases towards the upper end of the separation chamber. A further advantage with the conical shape is that it makes it easier to extract smaller particles since it provides an increasing upward force as the radius of the second channel decreases towards the upper end.

The material is fed to the separation chamber from above through the feeding pipe. The feeding pipe has a longitudinal axis extending between the upper and lower end of the feeding pipe. The feeding pipe and the separation chamber are concentrically arranged, which means that the longitudinal axis of the feeding pipe is aligned with an axis of symmetry of the separation chamber. Thus, the feeding pipe can be vertically arranged when the apparatus is in use, and the material supplied to the upper end of the feeding pipe will fall down into the separation chamber due to gravity. Accordingly, the supplied material is prevented from sticking to the walls of the feeding pipe. This is particularly advantageous when the supplied material is moist, such as wood material.

The second channel surrounds the feeding pipe and accordingly surrounds the first channel. The first and second channels are arranged coaxial. Preferably, the separation chamber has a larger inner diameter than the outer diameter of the feeding pipe to be able to receive the feeding pipe and to surround the feeding pipe. The second channel is formed between the feeding pipe and the separation chamber. Since the wall of the separation chamber is curved, it encourages the air flow to rotate in the second channel.

In one aspect, the separation chamber is shaped as a truncated cone having one opening in the narrow end and another opening is in the wider end of the truncated cone. In one aspect, the second opening is said opening is in the wider end of the truncated cone.

In one aspect, the feeding pipe penetrates through the opening in the narrow end of the separation chamber, so that said first opening is formed between the curved wall of the separation chamber and the feeding pipe to allow the rotating air flow and separated particle in the separation chamber to leave the separation chamber.

In one aspect, the first opening is annular and surrounds the feeding pipe.

In one aspect, the second opening is circular. Suitably, the second opening has a diameter corresponding to an inner diameter of the lower end of the separation chamber.

In one aspect, the air inlet unit comprises a housing defining a curved third channel for the air flow having an inlet opening for receiving the air and the third channel is arranged in communication with a lower end of the second channel to allow the air flow in the curved third channel to enter the lower end of the second channel.

In one aspect, the outlet unit comprises a housing defining a curved fourth channel for the air flow having an outlet opening for discharging the air and separated material, and the fourth channel is arranged in communication with the upper end of the second channel to allow the air flow in the second channel to enter the fourth channel.

The apparatus comprises a suction unit operatively connected to the outlet opening of the outlet unit and arranged for sucking air from said inlet opening to said outlet opening via said second, third and fourth channels so that a rotating air flow is formed in said second channel and smaller particles are transported upwards to the outlet unit by means of the rotating air flow while larger particles are moved downwards due to gravity. The suction unit sucks air from the fourth channel and by that generates a rotating air flow in the fourth channel. Since the fourth channel is curved, it encourages the air flow to rotate. The suction unit also sucks air from the second channel via the fourth channel and by that a rotating air flow is generated in the second channel. The curved third channel supplies air to the second opening of the separation chamber, where the rotating air flow in the second channel is started. Since the third channel is curved, it encourages the air flow to rotate. The fourth channel receives the rotating air flow including separated material and air from the second channel and guides the air flow to the outlet opening of the outlet unit where the separated particles can be collected. Due to the curved form of the fourth channel, the speed of the rotating air flow is essentially maintained when the air flow enters the outlet unit. Thus, the high speed of the rotating air flow is maintained. The combination of the third and fourth curved channels achieves a high-speed rotating air flow in the separation channel. The high-speed rotating air flow in combination with the conical shape of the curved wall of the separation chamber achieves a very efficient separation of particles, for example, of wood particles. Another advantage with the apparatus is that it enables separation of large volumes of material in relation to its own size.

The apparatus separates smaller particles from larger particles by means of cyclonic separation, which has been proven to be very efficient for separating particles such as wood particles. Due to the fact that the rotating air flow is formed in the second channel defined between the feeding pipe and the wall of the separation channel, the length of the part of the feeding pipe that protrudes into the separation chamber together with the flow rate of the rotating air flow define the cut point of the cyclone, and accordingly define a set maximum size of the particles that will be separated from the material. By reducing the length of the part of the feeding pipe that protrudes into the separation chamber, the length of the second channel is reduced and accordingly the size of the particles that reach the outlet unit is increased, i.e. the set maximum size of the separated particles is increased. By increasing the length of the part of the feeding pipe protruding into the separation chamber, the length of the second channel increase and accordingly the size of the particles that reach the outlet unit is decreased, i.e. the set maximum size of the separated particles is decreased. Thus, by varying the length of the part of the feeding pipe that protrudes into the separation chamber it is possible to provide a coarse adjustment of the size of the particles to be separated.

The invention enables dividing material containing particles of different sizes into a first fraction of particles having a smaller size and a second fraction of particles having a larger size. The invention makes it easy to control and change the cut-off point for the particle size of the cyclone, and accordingly the size of the particles in the separated fractions. This is advantageous since different applications require different sizes of the separated particles. For example, the invention is useful for separating wood power into two fractions of particles, one smaller and one larger than a set size.

The sentence "a suction unit operatively connected to the outlet opening" means that the outlet opening can be directly or indirectly connected to the suction unit. However, the connection between the outlet opening and the suction unit should preferably be airtight to achieve a depression at the outlet unit. The upper end of the second channel is in communication with the fourth channel.

A further advantage is that the apparatus does not have any motors inside the separation chamber or in close vicinity of the separation chamber. Instead, the apparatus has a suction unit connected to the outlet unit arranged to generate the rotating air flow in the second channel by sucking air from the air inlet unit to the outlet unit. This is advantageous since it reduces the risk of setting the material inside the separation chamber on fire due to sparks from the motor. This is particularly important when handling inflammable materials, such as, wood powder.

The suction unit is a unit, for example, an air exhauster or a fan, which generates depression at the outlet unit. Due to the pressure differential between the inlet and outlet units a rotating air flow is generated from the inlet unit, through the second channel to the outlet unit. The rotating flow brings particles from the lower end of the feeding pipe to the outlet unit. The particles follow the air flow and are transported to the outlet unit by means of the air flow. The outlet unit can be directly or indirectly connected to the suction unit.

In one aspect, the curved fourth channel surrounds the feeding pipe. Suitably, the curved fourth channel surrounds an upper part of the feeding pipe.

In one aspect, the curved third channel surrounds the separation chamber. Suitably, the curved third channel surrounds a lower part of the separation chamber.

In one aspect, the first opening is annular and surrounds the feeding pipe. The curved fourth channel is arranged in communication with the second channel via the annular first opening of the separation chamber. Due to the fact that the first opening is annular it allows the rotating air flow to enter the fourth channel from the second channel from all directions. Accordingly, the air can be sucked from the separation chamber into the outlet unit all the way around the feeding pipe and by that the separated particles are prevented from falling downwards to the bottom of the separation chamber.

In one aspect, the housing of the outlet unit is attached to the upper end of the separation chamber and the housing of outlet unit surrounds the annular first opening of the separation chamber. Thus, the annular first opening is formed between the second channel and the fourth channel to allow the rotating air flow in the second channel to enter the fourth channel.

In one aspect, the air inlet unit comprises a third opening arranged in communication with the second opening of the separation chamber to allow the rotating air flow in the curved third channel to enter the second channel, and said third opening is annular. The third channel is arranged in communication with the second channel via the third opening and first opening of the separation chamber. Due to the fact that the third opening is annular it allows the rotating air flow from the third channel to enter the second opening of the separation chamber from all directions and by that create an upgoing airflow in the second opening, which prevents smaller particles from falling downwards. Heavier particles will still move downwards due to the gravity.

In one aspect, the third opening is formed between the separation chamber and the housing of the air inlet unit and said third opening surrounds the separation chamber.

In one aspect, a third opening is formed between the separation chamber and the housing of the air inlet unit, said third opening is annular and surrounds the separation chamber, the third opening is arranged in communication with the second opening of the separation chamber to allow the air flow in the curved third channel to enter the second channel via the third and second openings.

In one aspect, the housing of the air inlet unit is attached to the separation chamber and surrounds the separation chamber so that the third opening is formed between the housing of the air inlet unit and the separation chamber. Suitably, the housing of the air inlet unit is attached to a lower part of the separation chamber.

In one aspect, the third opening and the second opening are concentrically arranged.

In one aspect, the feeding pipe is cylindrical. For example, the first channel has a circular cross-section. However, the feeding pipe and the first channel can have other cross-sectional shapes, such as rectangular or hexagonal.

In one aspect, the separation chamber has a circular cross section. In one aspect, the second channel has an annular cross section. The feeding pipe is arranged in the separation chamber so that the second channel is formed between the feeding pipe and the separation chamber.

According to an aspect of the invention, the suction unit comprises a fan with a variable speed. For example, the suction unit may comprise a motor for actuating the fan and an inverter unit adapted to vary the speed of the motor. Thus, it is possible to adjust the speed of the fan and by that adjust the flow rate of the rotating air flow, and accordingly to adjust the cut point of the cyclone and by that control the size of the separated particles. This aspect of the invention makes it possible to control the size of the separated particles with high accuracy by adjusting the speed of the fan.

According to an aspect of the invention, the apparatus comprises an impeller rotatably arranged below the feeding pipe and at a distance from the lower end of the feeding pipe, and the curved wall of the separation chamber surrounds the impeller such that a gap is formed between the curved wall and the outer periphery of the impeller. The impeller receives unseparated material from the feeding pipe. The material is loosen due to the rotational movement of the impeller, and larger particles are moved to the periphery of the impeller by means of the centripetal force and fall down through the gap between the curved wall and the outer periphery of the impeller, while the smaller particles are moved upwards to the entrance of the second channel by means of the rotating air flow. Thus, the impeller improves the separation of the particles in the material.

According to an aspect of the invention, the impeller is arranged rotatable about an axis of symmetry of the separation chamber, and the rotation of the impeller is driven by means of the rotating air flow caused by the suction unit.

According to an aspect of the invention, the second opening of the separation chamber is arranged below the impeller for receiving air from the air inlet unit, and the air inlet unit is arranged for supplying air to the second opening of the separation chamber.

According to an aspect of the invention, the separation chamber is rotationally symmetric with a circular cross section.

According to an aspect of the invention, the outlet unit is arranged for discharging air and separated material at an upper end of the separation chamber.

According to an aspect of the invention, the outlet unit comprises a curved housing surrounding the upper end of the feeding pipe, arranged in communication with an upper end of the second channel, and having an outlet opening for discharging air and separated material, and the outlet opening is operatively connected to the suction unit. This means that the outlet opening can be directly or indirectly connected to the suction unit. However, the connection between the outlet opening and the suction unit should preferably be air tight to achieve a depression at the outlet unit. The upper end of the second channel is in communication with the interior of the curved housing. The curved housing receives the rotating air flow including separated material and air from the second channel, and guides the air flow to the outlet opening of the outlet unit where the separated particles can be collected. Due to the curved form of the housing, the speed of the rotating air flow is essentially maintained when the air flow enters the outlet unit. Thus, the high speed of the rotating air flow is maintained.

According to an aspect of the invention, the apparatus comprises an air lock arranged to prevent air from entering the first channel together with the unseparated material. The air lock prevents uncontrolled inlet of air to the separation chamber via the feeding pipe, which may disturb the rotational air flow and by that reduce the accuracy of the separation.

According to an aspect of the invention, the apparatus comprises a filter unit arranged between the outlet unit and the suction unit. The filter unit prevents the small particles from reaching the suction unit, and by that reduces the risk for fire if the small particles enter a motor of the suction unit.

According to an aspect of the invention, the apparatus comprises a collector unit disposed below the gap for collecting separated larger particles.

The apparatus according to the invention can separate particles of different sizes and weights. The apparatus is particularly useful for separating wood particles from a wood powder. However, the apparatus according to the invention is useful also for separating many different types of material, such as plastic particles, metal particles, dust or seed.

BRIEF DESCRIPTION OF THE DRAWINGS

The invention will now be explained more closely with reference to the appended figures.

FIG. 4 shows a cross-section B-B through the apparatus shown in FIG. 2 illustrating the air flow of material and separated particles in the apparatus.

FIG. 5 shows a cross-section C-C through the apparatus shown in FIG. 3.

FIG. 6 shows a cross-section D-D through the apparatus shown in FIG. 3.

DETAILED DESCRIPTION

Figure 1:
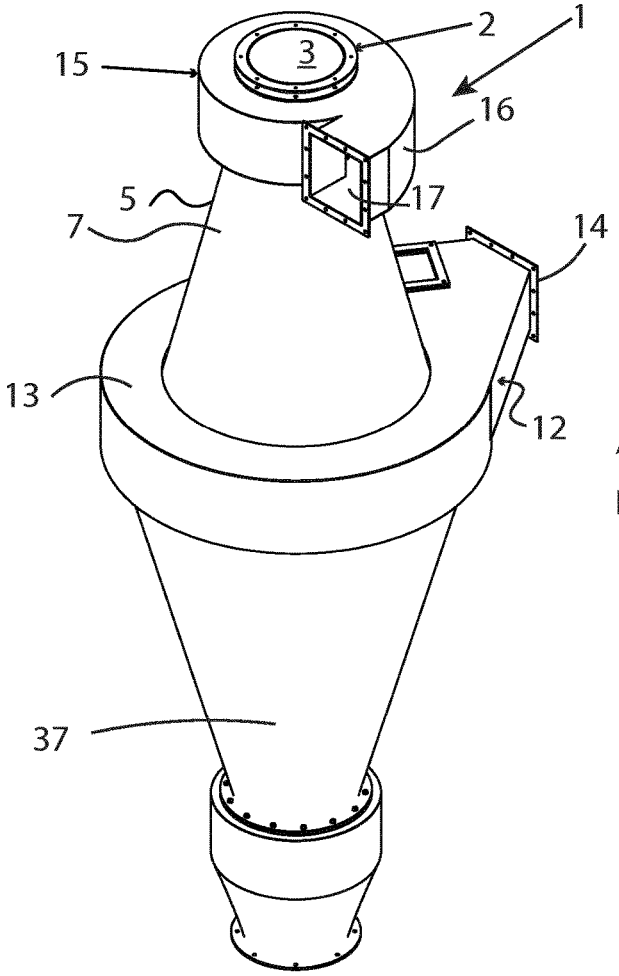
FIG. 1 shows a perspective view of an example of an apparatus for separating material according to the invention.
Figure 2:
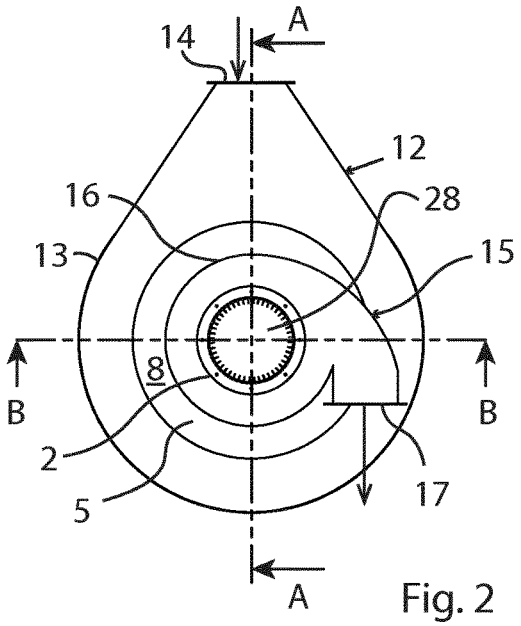
FIG. 2 shows the apparatus shown in FIG. 1 seen from above.
Figure 3:
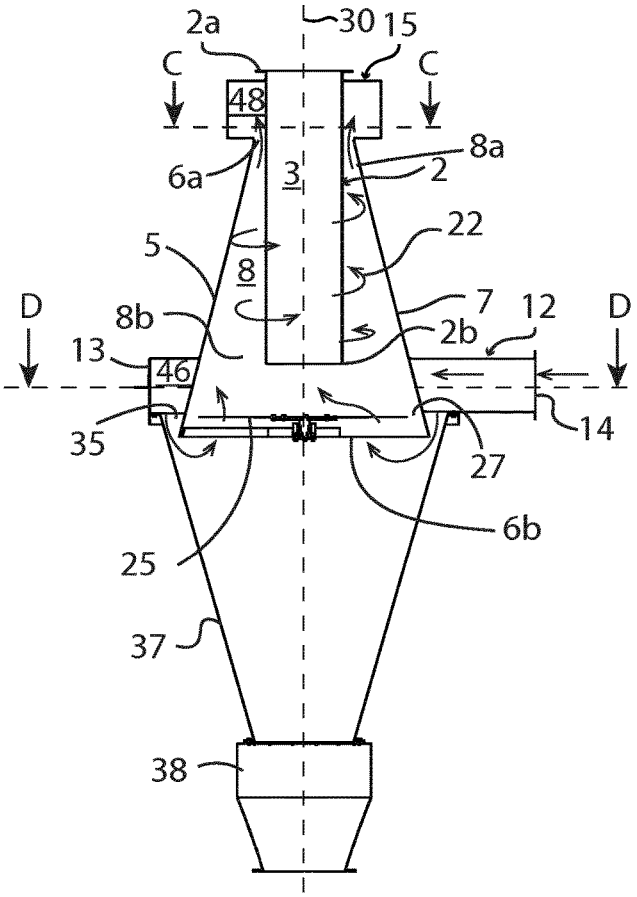
FIG. 3 shows a cross section A-A through the apparatus shown in FIG. 2 illustrating the air flow in the apparatus.

FIG. 1 shows a perspective view of an example of an apparatus 1 according to the invention for separating smaller particles from larger particles in a material including particles of different sizes by means of cyclonic separation. FIG. 2 shows the apparatus shown in FIG. 1 seen from above. FIG. 3 shows a cross section A-A through the apparatus shown in FIG. 2, and FIG. 4 shows a cross section B-B through the apparatus. FIG. 5 shows a cross section C-C through the apparatus shown in FIG. 3, and FIG. 6 shows a cross section D-D through the apparatus shown in FIG. 3.

The apparatus comprises a separation chamber 5 where separation of the material takes place and a feeding pipe 2 for feeding the material to the separation chamber 5, as shown in FIG. 4. The feeding pipe 2 is tubular and defines a first channel 3 for guiding transportation of the material to the separation chamber 5. The feeding pipe 2 has an inlet opening for receiving the material to be separated in an upper end 2*a* and an outlet opening for supplying the material to the separation chamber 5 at a lower end 2*b* of the feeding pipe. The radius of the separation chamber continually decreases from the lower end 2*b* to the upper end 2*a*. The feeding pipe 2 is vertically arranged.

The separation chamber 5 has curved wall 7 surrounding the feeding pipe 2 such that a second channel 8 is formed between the feeding pipe and the wall. The second channel 8 has an upper end 8*a* and a lower end 8*b*, as shown in FIG. 3. The second channel 8 extends between the lower end 2*b* of the feeding pipe and the upper end 5*a* of the separation chamber 5. The curved wall 7 is conically shaped and tapers from the lower end 5*b* to the upper end 5*a* of the separation chamber. Accordingly, the separation chamber 5 and the second channel 2 are also conical and taper from the lower end 5*b* to the upper end 5*a* of the separation chamber. The feeding pipe and the separation chamber are concentrically arranged. The second channel 8 is annular and surrounds the feeding pipe 2, as shown in FIG. 2.

The separation chamber 5 has a larger inner diameter d1 than the outer diameter d2 of the feeding pipe. The curved wall 7 enables the generation of a rotating flow of air and particles, i.e. a cyclone, inside the separation chamber 5. Preferably, the separation chamber 5 is rotationally symmetric with a circular cross section in order to generate a smooth flow. The feeding pipe 2 and the separation chamber 5 are concentrically arranged. The separation chamber 5 is conical having a wide end and a narrow end. The separation chamber 5 has a first opening 6*a* at an upper end 5*a*, and a second opening 6*b* at a lower end 5*b*. Since the curved wall 7 tapers from the second opening 6*b* to the first opening 6*a*, the first opening 6*a* is narrower than the second opening 6*b*. The radius of separation chamber 5 is continually decreasing towards the first opening 6*a*. The second channel 8 is conically shaped and tapers from the second opening 6*b* towards the first opening 6*a* of separation chamber 5. In this example, the first opening 6*a* is annular and surrounds the feeding pipe 2 and the second opening 6*b* is circular.

The feeding pipe 2 penetrates through the first opening 6*a* of the separation chamber 5. The feeding pipe 2 protrudes into the separation chamber 5 and ends at a distance above the second opening 6*b*. The maximum size of the separated particles depends on the length of the second channel 8, and accordingly on the length of the part of the feeding pipe 2 protruding into the separation chamber, i.e. the distance between the upper end 5*a* of the separation chamber 5 and the lower end 2*b* of the feeding pipe. Thus, the apparatus can be roughly calibrated by selecting a certain length of the feeding pipe and adapting the length of the part protruding into the separation chamber in dependence on the desired maximum size of the particles to be separated from the material.

The apparatus further comprises an air inlet unit 12 arranged for supplying air to the lower end 8*b* of the second channel, and an outlet unit 15 arranged at an upper end 8*a* of the second channel for discharging air and separated material. In this example, the outlet unit 15 comprises a curved housing 16 defining a curved fourth channel 48 surrounding the upper end 2*a* of the feeding pipe and arranged in communication with an upper end 8*a* of the second channel. The curved housing 16, and accordingly the fourth channel 48, has an outlet opening 17 for discharging air and separated material, as shown in FIG. 5. The curved housing 16 of the outlet unit 15 is at least partly ring-shaped and has a central though-hole for receiving the feeding pipe 2. In this example, the upper end 5*a* of the separation chamber 5 is attached to the outlet unit 15. The central through-hole of the curved housing 16 of the outlet unit 15 has an upper circular opening having a diameter corresponding to the outer diameter d2 of the feeding pipe and tightly connected to an upper part of the feeding pipe to provide an airtight seal between the outlet unit and the feeding pipe. The central through-hole of the curved housing 16 of the outlet unit has a lower circular opening having a diameter corresponding to the diameter of the upper end 5*a* of the separation chamber. The upper end 5*a* of the separation chamber 5 is attached to the outlet unit 15 so that the first opening 6*a* is arranged between the second channel 8 and the interior of the curved housing 16 to allow the rotating air flow 22 to enter the curved fourth channel 48 of the outlet unit 15, as shown in FIG. 3. Thus, the second channel 8 is in communication with fourth channel 48, i.e. the interior of the curved housing 16 of the outlet unit. In this example, the first opening 6*a* surrounds the feeding pipe 2, as shown in FIG. 5.

In this example, the air inlet unit 12 comprises a curved housing 13 surrounding the separation chamber 5. The housing 13 defines a curved third channel 46 for the air flow and has an inlet opening 14 for receiving the air. The third channel 46 is arranged in communication with the lower end 8*b* of the second channel via a third opening 35 and the second opening 6*b* of the separation chamber, as shown in FIG. 3. In this example, the third opening 35 is annular and surrounds the separation chamber. The curved housing 13 of the inlet unit is attached to the separation chamber 5 so that the third opening 35 is formed between the interior of separation chamber 5 and the curved housing 13 of the air inlet unit to allow air from the inlet unit 12 to enter the second opening 6*b* of the separation chamber. In this example, the inlet unit 12 is attached to a lower part of the separation chamber 5. In this example, the curved housing 13 of the inlet unit 12 is at least partly ring-shaped and has a central though-hole for receiving the separation chamber 5. The central through-hole of the inlet unit 12 has an upper circular opening having a diameter corresponding to the outer diameter of a lower part of the separation chamber and is tightly connected to the separation chamber to provide an airtight seal between the inlet unit 12 and the separation chamber 5. The curved housing 13 of the inlet unit 12 has a circular opening having a diameter larger than the diameter of the lower part of the separation chamber 5 so that the annular third opening 35 is formed between the interior of the separation chamber 5 and the curved housing 13 of the inlet unit to allow air from the curved channel 46 of the inlet unit 12 to enter second opening 6*b* of the separation chamber 5. Thus, the second channel 8 is in communication with the interior of the curved housing 13 of the inlet unit.

The apparatus further comprises a suction unit 18 connected to the outlet unit 15 for sucking air from the air inlet unit 12 to the outlet unit 15 so that a rotating air flow 22 is formed in the second channel 8 and smaller particles are transported upwards to the outlet unit 15 by means of the rotating air flow 22 while larger particles are moved downwards due to gravity. The suction unit is disposed outside the separation chamber 5 and the outlet unit 15. The outlet opening 17 of the outlet unit is operatively connected to the suction unit 18. Thus, the outlet unit can be directly or indirectly connected to the suction unit. In one embodiment, the suction unit 18 comprises a motor (not shown) and a fan 19 with a variable speed, as shown in FIG. 4. The suction unit 18 may be provided with a control device for controlling the speed of the fan. For example, the suction unit comprises a frequency converter adapted to control the speed of the fan 19. The maximum size of the separated material depends on the flow rate of the air flow 22 in the second channel 8, which depends on the speed of the fan. By having a fan with a variable speed, it is possible to control the maximum size of the separated material by varying the speed of the fan. Suitably, the control device is designed to allow a user to vary the speed of the fan so that the user easily can adjust the maximum size of the separated material. The maximum size of the separated material depends on the length of the second channel as well as the flow rate of the air flow in the second channel. Thus, the apparatus can firstly be roughly calibrated by adjusting the part of the feeding pipe protruding into the separation chamber, and then fine-tuned by adjusting the speed of the fan. Thus, it is possible to calibrate the apparatus to achieve a desired size of the separated material with high accuracy.

The apparatus also comprises a lower part 37 surrounding the lower end 5*b* of the separation chamber 5 and is attached to the air inlet unit 12. In this example the lower part 37 is conical. In an alternative example, the lower part 37 can be cylindrical. In one aspect of the invention, the apparatus comprises collector unit 38 for collecting the separated larger particles. The collector unit 38 is attached to the lower part 37. The collector unit is optional.

Figure 7:
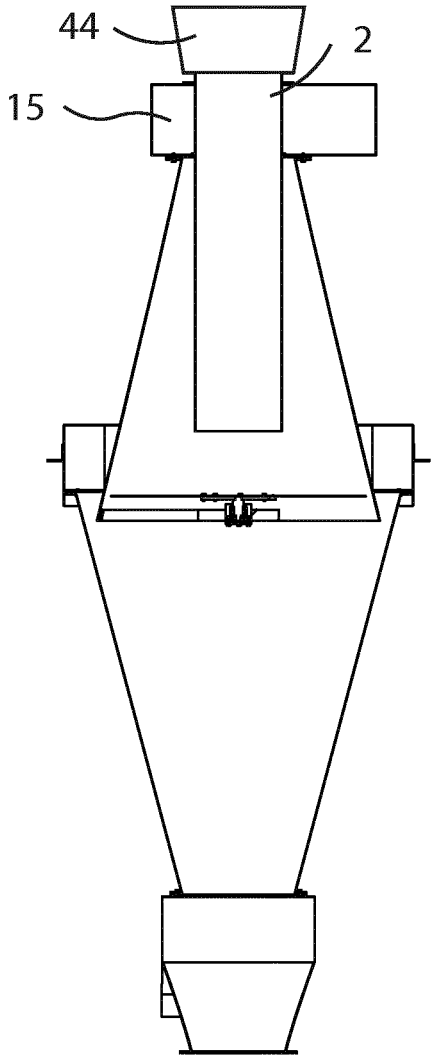
FIG. 7 shows another example of an apparatus for separating material according to the invention.

Suitably, a filter unit 40 is arranged between the suction unit 18 and the opening 17 of the outlet unit to prevent small particles from entering the suction unit 18 and by that reduce the risk of causing a fire if the small particles enter a motor of the suction unit, as shown in FIG. 4. Further, the apparatus may have an air lock 44 arranged to prevent air from entering the first channel 3 of the feeding pipe 2 together with the unseparated material, as shown in FIG. 7.

In one aspect of the invention, the apparatus comprises an impeller 25 rotatable arranged below the feeding pipe 2 and at a distance from the lower end 2*b* of the feeding pipe, and the curved wall 7 of the separation chamber surrounds the impeller 25 such that a gap 27 is formed between the curved wall 7 and the outer periphery 26 of the impeller, as seen in FIGS. 3 and 6. Preferably, the impeller is centred in the separation chamber. The size of the gap 27 should be larger than the size of the largest particles to be separated. For example, the gap is larger than 20 mm.

The second opening 6*b* of the separation chamber 5 is arranged below the impeller 25 for receiving air from the air inlet unit 12, and the air inlet unit 12 is arranged to supply air to the second opening 6*b* of the separation chamber. The impeller 25 is arranged rotatable about an axis of symmetry 30 of the separation chamber 5, and the rotation of the impeller 25 is driven by means of the rotating air flow 22 caused by the suction unit 18. The impeller comprises a centrum plate 28 and a plurality of blades 29 extending from the centrum plate 28 to the outer periphery 26 of the impeller. The upper surface of the impeller faces the outlet of the feeding pipe. The material from the feeding pipe hits the central plate 28 that pulverizes the material into particles. For example, the material consists of aggregated particles, such as lumps, of different sizes that need to be separated into separate particles before the smaller particles can be separated from the larger particles. The impeller causes loosening of aggregated material to enable separation of the aggregated material into separate particles. However, the impeller 25 is optional. If the material fed to the apparatus is not aggregated, the impeller is not needed.

The function of the apparatus will now be explained with reference to the FIGS. 3, 4, and 5. The arrows shown in FIGS. 3 and 5 illustrate the air flow through the apparatus, and the arrows shown in FIG. 4 illustrate the flow of material and particles in the apparatus. When the suction unit 18 is started, a rotating air flow 22 is generated inside the separation chamber 5. The rotating air flow 22 forms a cyclone inside the separation chamber. The suction unit is tuned so that the flow rate of the rotating air flow 22 allows particles smaller than a set maximum size to be moved upwards in the second channel 8 and particles larger than the set maximum size to be moved downwards due to gravity acting on the particles.

The suction unit 18 sucks air from the inlet unit 12 to the outlet unit 15 through the second channel 8, as seen in FIG. 3. The air flow enters the inlet unit 12 through the opening 14 and follows the curved housing 13 of the air inlet unit to cause the air flow to rotate, as shown in FIG. 5. The rotating air flow enters through the annular opening 35 between housing 13 of the air inlet unit 12 and the separation chamber 5, and then enters the separation chamber 5 through the lower end 5*b* of the separation chamber 5, as shown in FIG. 3. If the apparatus has an impeller 25, the rotating air flow hits the blades 29 of the impeller and causes the impeller to rotate. The rotating air flow penetrates through the impeller and the gap 27. The rotating air flow 22 enters the lower end 8*b* of the second channel 8 and rotates around the feeding pipe 2 towards the upper end 8*a* of the second channel, as shown in FIG. 3. The rotating air flow 22 enters the outlet unit 15 through the first opening 6*a* between second channel 8 and outlet unit 15 at the upper end 8*a* of the second channel 8. The rotating air flow 22 enters the curved housing 16 of the outlet unit and leaves the outlet unit through the opening 17 of the outlet unit, as shown in FIG. 5.

Material to be separated is fed to the first channel 3 via the upper end 2*a* of the feeding pipe 2 and is supplied to the separation chamber 5 at the lower end 2*b* of the feeding pipe, as shown in FIG. 4. The material hits the central plate 28 of the rotating impeller 25. When the material has hit the impeller 25, the material is loosen and small particles of the material, i.e. particles having a size below the set maximum size, are moved upwards in the separation chamber 5 by means of the rotating air flow 22, and the larger particles, i.e. particles having a size above the set maximum size, are moved horizontally towards the gap 27 by centrifugal forces caused by the rotation of the impeller 25, and when the larger particles reach the gap 27 they will fall down below the impeller where they can be collected. The smaller particles will follow the rotating air flow 22 upwards towards the outlet unit 15 and leave the outlet unit 15 through the opening 17 of the outlet unit, as shown in FIG. 5.

The present invention is not limited to the embodiments disclosed but may be varied and modified within the scope of the following claims. For example, the separation chamber, the air inlet unit and outlet unit can be designed in different ways. In an alternative example, the apparatus can be provided with a second air inlet unit disposed in a lower part of the apparatus below the first air inlet unit. In alternative embodiments of the invention, the second channel can be cylindrical or have the shape of an inverted cone.

REFERENCE LIST

1 Apparatus for separating particles
2 Feeding pipe
2*a* Upper end of feeding pipe
2*b* Lower end of feeding pipe
3 First channel
5 Separation chamber
5*a* Upper end of the separation chamber
5*b* Lower end of the separation chamber
6*a* First opening (outlet) of the separation chamber
6*b* Second opening (inlet) of the separation chamber
7 Curved wall of the separation chamber
8 Second channel
8*a* Upper end of the second channel
8*b* Lower end of the second channel
12 Air inlet unit
13 Curved housing of the air inlet unit
14 Inlet opening of the air inlet unit
15 Outlet unit
16 Curved housing of the outlet unit
17 Opening of the outlet unit
18 Suction unit
19 Fan of the suction unit
22 Rotating flow
25 Impeller
26 Outer periphery of the impeller
27 Gap
28 Centrum plate of the impeller
29 Blades of the impeller
30 Axis of symmetry of the separation chamber
d1 Inner diameter of the separation chamber
d2 Outer diameter of the feeding pipe
35 Third opening between second channel and inlet unit
37 Lower part
38 Collector unit
40 Filter unit
44 Air lock
46 Curved third channel of inlet unit
48 Curved fourth channel of outlet unit

The invention claimed is:

1. An apparatus (1) for separating smaller particles from larger particles by cyclonic separation, comprising:

a feeding pipe (2) having an upper end (2*a*) for receiving material to be separated and defining a first channel (3) for transporting the material to a lower end (2*b*) of the feeding pipe, a separation chamber (5) having an outer curved wall (7), a first opening (6*a*) arranged at an upper end (5*a*) of the separation chamber (5), a second opening (6*b*) arranged at a lower end (5*b*) of the separation chamber (5), and surrounding the feeding pipe (2), a second channel (8) formed between the feeding pipe (2) and the outer curved wall (7), an air inlet unit (12) arranged for supplying air to the second opening (6*b*) of the separation chamber (5), and an outlet unit (15) arranged for receiving air and separated material from the first opening (6*a*) of the separation chamber (5) and discharging the air and separated material, wherein the feeding pipe (2) and the separation chamber (5) are concentrically arranged, and the second channel (8) is conically-shaped and continuously decreases toward the upper end (5*a*) of the separation chamber (5).

2. The apparatus according to claim 1, wherein said air inlet unit (12) comprises a housing (13) defining a curved third channel (46) for the air flow having an inlet opening (14) for receiving the air and the third channel is arranged in communication with a lower end (8*b*) of the second channel to allow the air flow in the curved third channel (46) to enter the lower end of the second channel (8), said outlet unit (15) comprises a housing (16) defining a curved fourth channel (48) for the air flow having an outlet opening (17) for discharging the air and separated material, the fourth channel is arranged in communication with an upper end (8*a*) of the second channel to allow the air flow in the second channel (8) to enter the fourth channel (48), and the apparatus comprises a suction unit (18) operatively connected to the outlet opening (17) of the outlet unit (15) and arranged for sucking air from said inlet opening (14) to said outlet opening (17) via said third, second and fourth channels so that a rotating air flow (22) is formed in said second channel (8) and smaller particles are transported upwards to the outlet unit (15) by the rotating air flow while larger particles are moved downwards due to gravity.

3. The apparatus according to claim 2, wherein said curved third channel (46) surrounds the separation chamber (5) and said curved fourth channel (48) surrounds the feeding pipe.

4. The apparatus according to claim 2, wherein said first opening (6*a*) is annular and surrounds the feeding pipe (2), and the fourth channel (48) is arranged in communication with the second channel (8) via said first opening (6*a*) of the separation chamber (5).

5. The apparatus according to claim 4, wherein the housing (16) of the outlet unit (15) is attached to the upper end (5*a*) of the separation chamber (5), and the housing (16) of outlet unit surrounds said first opening (6*a*) of the separation chamber.

6. The apparatus according to claim 2, wherein the air inlet unit (12) comprises a third opening (35) arranged in communication with the second opening (6*b*) of the separation chamber to allow the rotating air flow (22) in the curved third channel (46) to enter the second channel (8), and said third opening (35) is annular.

7. The apparatus according to claim 6, wherein the third opening (35) is formed between the separation chamber (5) and the housing (13) of the air inlet unit (12) and said third opening (35) surrounds the separation chamber (5).

8. The apparatus according to claim 2, wherein the suction unit (18) comprises a fan (19) with a variable speed.

9. The apparatus according to claim 1, wherein the apparatus comprises an impeller (25) rotatably arranged below the feeding pipe (2) and at a distance from the lower end (2*b*) of the feeding pipe, and the curved wall (7) of the separation chamber surrounds the impeller (25) such that a gap (27) is formed between the curved wall (7) and the outer periphery (26) of the impeller.

10. The apparatus according to claim 9, wherein said impeller (25) is arranged rotatable about an axis of symmetry (30) of the separation chamber (5), and the rotation of the impeller (25) is driven by said rotating air flow (22) caused by the suction unit.

11. The apparatus according to claim 10, wherein said second opening (6*b*) of the separation chamber is arranged below the impeller (25) for receiving air from the air inlet unit (12), and the air inlet unit (12) is arranged for supplying air to the second opening (6*b*) of the separation chamber.

12. The apparatus according to claim 9, wherein said second opening (6*b*) of the separation chamber is arranged below the impeller (25) for receiving air from the air inlet unit (12), and the air inlet unit (12) is arranged for supplying air to the second opening (6*b*) of the separation chamber.

13. The apparatus according to claim 9, wherein the apparatus comprises a collector unit (38) disposed below said gap (27) for collecting separated larger particles.

14. The apparatus according to claim 1, wherein the apparatus comprises an air lock (44) arranged to prevent air from entering the first channel together with the unseparated material.

15. The apparatus according to claim 1, wherein the apparatus comprises a filter unit (40) arranged between the outlet unit (15) and the suction unit (18).

16. The apparatus according to claim 1, wherein the second channel (8) is shaped such that radial width thereof (d1-d2) decreases toward the upper end (5*a*) of the separation chamber (5).

* * * * *